US008438752B2

(12) United States Patent
Mennucci et al.

(10) Patent No.: US 8,438,752 B2
(45) Date of Patent: May 14, 2013

(54) YANKEE CYLINDER FOR PAPER PRODUCING MACHINE

(75) Inventors: Giovan Battista Mennucci, Stefano di Moriano Lucca (IT); Simone Pieruccini, Lucca (IT); Paolo Raffaelli, Lucca (IT); Francesco Simoncini, Lucca (IT)

(73) Assignee: Toscotec S.p.A., Marlia, Lucca (IT)

( * ) Notice: Subject to any disclaimer, the term of this patent is extended or adjusted under 35 U.S.C. 154(b) by 779 days.

(21) Appl. No.: 12/528,673

(22) PCT Filed: Mar. 1, 2007

(86) PCT No.: PCT/IT2007/000147

§ 371 (c)(1),
(2), (4) Date: Jan. 27, 2010

(87) PCT Pub. No.: WO2008/105005

PCT Pub. Date: Sep. 4, 2008

(65) Prior Publication Data

US 2010/0132903 A1 Jun. 3, 2010

(51) Int. Cl.
*F26B 11/02* (2006.01)

(52) U.S. Cl.
USPC ..... 34/117; 34/124; 162/357; 503/227; 428/512

(58) Field of Classification Search ..... 34/117, 34/124, 130, 110, 112, 119; 162/357; 503/201, 503/227; 428/32.39, 32.5, 512; 430/28
See application file for complete search history.

(56) References Cited

U.S. PATENT DOCUMENTS

| | | | | |
|---|---|---|---|---|
| 3,116,985 | A | 1/1964 | Kraus | |
| 3,118,743 | A * | 1/1964 | Malmstrom et al. | 34/110 |
| 3,224,084 | A | 12/1965 | Johnson | |
| 3,911,595 | A * | 10/1975 | Lande | 34/110 |
| 3,914,875 | A | 10/1975 | Schiel | |
| 4,320,582 | A * | 3/1982 | Klippstein et al. | 34/454 |
| 4,520,578 | A | 6/1985 | Schiel et al. | |
| 6,325,896 | B1 * | 12/2001 | Hultcrantz et al. | 162/289 |
| 6,877,246 | B1 * | 4/2005 | Hada et al. | 34/119 |
| 2007/0289156 | A1 * | 12/2007 | Kloibhofer et al. | 34/119 |
| 2010/0132903 | A1 * | 6/2010 | Mennucci et al. | 162/357 |
| 2012/0168106 | A1 * | 7/2012 | Mennucci et al. | 162/357 |

FOREIGN PATENT DOCUMENTS

| | | |
|---|---|---|
| DE | 2707923 | 8/1978 |
| GB | 685009 | 12/1952 |
| IT | WO 2006057023 | 6/2006 |

* cited by examiner

*Primary Examiner* — Stephen M. Gravini
(74) *Attorney, Agent, or Firm* — McGlew and Tuttle, P.C.

(57) ABSTRACT

The steel-made Yankee cylinder includes a cylindrical shell (11) joined to two ends (13, 15), to which are fixed respective-support journals (3). The cylindrical shell (11) is joined to the ends through a circumferential weld formed between opposing surfaces of each end and of the cylindrical shell.

39 Claims, 9 Drawing Sheets

A
3
5
3A
II
IV
13
39
16
35
41
13A
11A
1
31
31A
11
33
36
34
37
41
15A
15
3B
16
7
A
3

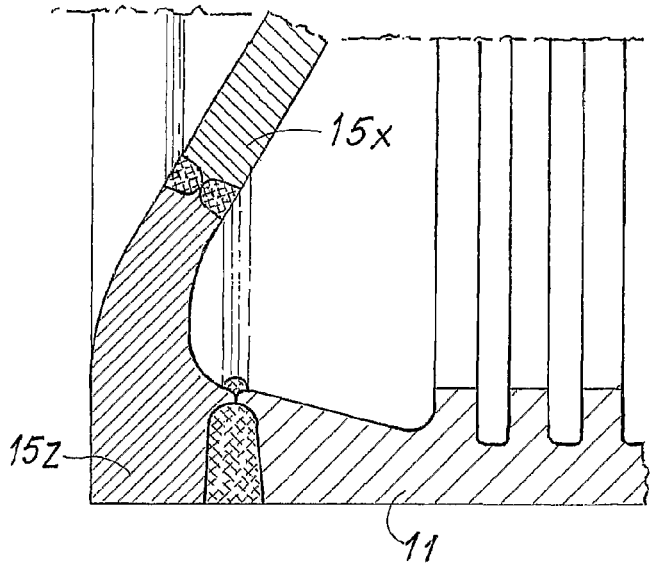
Fig. 13A
Fig. 13B
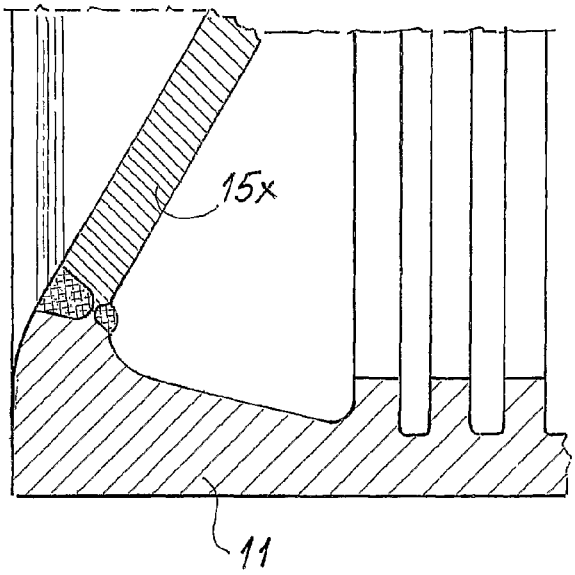
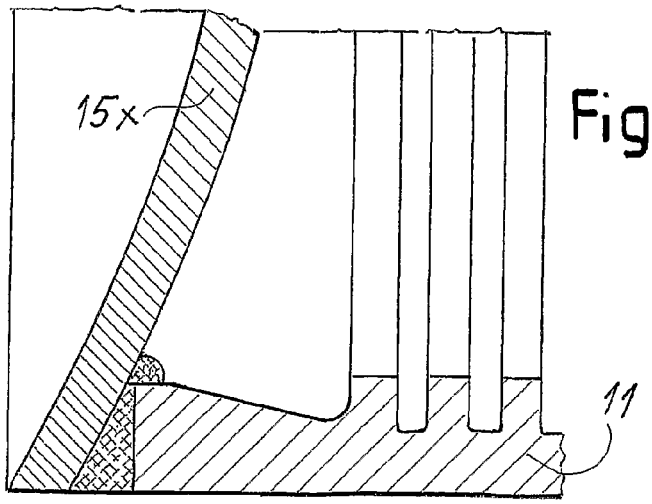
Fig. 13C

YANKEE CYLINDER FOR PAPER PRODUCING MACHINE

TECHNICAL FIELD

This invention concerns improvements to the construction of so-called Yankee cylinders for drying paper in wet paper producing systems.

PRIOR ART

For paper production a wet process is most commonly used, in which a slurry of cellulose fibers and water, with possible additives of a varying nature, is distributed through one or more headboxes on a formation wire, which moves along a direction of advancement. A small amount of water is drained through the wire to increase the dry content of the layer of slurry, which forms on the wire itself. With subsequent passages between more wires and/or wires and felts, a gradual reduction in the water content is achieved from the cellulose fiber layer to reach a suitable consistency, in other words a suitable dry content which allows the passage of the sheet of paper through a drying system.

Usually, the drying system includes a so-called Yankee cylinder. This is a large cylinder, typically with a 2-6 m diameter, internally heated for example by steam, and around which the sheet of wet paper is guided. The paper dries due to the heat from inside the Yankee cylinder and is then removed from the cylindrical surface of the cylinder itself, for example using a doctor blade or simply by tension. Removal by scraping is typically used in the production of crepe paper, as the blade in addition to removing the sheet of dried fibers from the Yankee cylinder, introduces a certain level of crepe which makes the paper elastic. Removal through tension is used for the production of smooth paper.

Usually the Yankee cylinders are produced in cast iron. These cylinders are of heavy weight and therefore present a considerable thermal inertia and a poor performance due to the features of thermal transmission through the cylinder wall towards the paper to be dried.

Therefore systems for producing steel Yankee cylinders have been researched.

U.S. Pat. No. 3,911,595 and U.S. Pat. No. 4,320,582 disclose construction systems of Yankee cylinders through assembly by bolting a cylindrical shell and so-called ends or end walls which close the surfaces at the ends the cylinder itself and to which are fixed journals, through which the cylinder is supported in appropriate roller bearings and through which the thermal carrier fluid, usually steam, is circulated, to heat the Yankee cylinder.

U.S. Pat. No. 3,224,084 describes a Yankee cylinder obtained through welding of a band or strip of steel wound helicoidally. The construction of this cylinder is extremely complex and the presence of helicoidal welding lines on the surface of the cylinder makes this difficult to produce as well as critical from the point of view of the integrity of the welding and therefore of the safety of the cylinder, due to the high pressure of steam which can occur inside it during normal operation.

Actually, one of the most critical aspects of the construction of Yankee cylinders is the elevated stress (some of a fatigue nature) to which this machinery is submitted due to the conditions in which it has to work. The stress is due to the pressure of the internal steam, the weight, the centrifugal force, the differentials in the thermal expansions due to the non-uniform thermal distribution. Furthermore the cylinder, rotating, is submitted to the fatigue action of one or two presses, whose function is in itself known, which exert elevated values of linear pressure on the shell of the cylinder itself.

OBJECTS AND SUMMARY OF THE INVENTION

An object of this invention is to provide a Yankee cylinder, more specifically a steel Yankee cylinder, using a simple and safe construction system.

According to a first aspect, the invention provides a steel Yankee cylinder including a cylindrical shell joined to two ends, to which are fixed support journals, characterized in that the cylindrical shell is secured to the ends through a circumferential welding produced between contact surfaces of each end and the cylindrical shell respectively.

According to a preferred embodiment the cylinder has a welding including a circular bead on one surface, preferably the external surface of the cylinder, and a back bead, i.e. a secondary welding bead, on the other surface, preferably the internal face of the cylinder. This guarantees a greater integrity of the welding and greater safety.

Advantageously, the welding bead and, if present, the back weld, are in a position to allow radiographic testing. For this purpose it is preferable for the back weld of the bead to be arranged on an exposed surface of the cylinder structure, within the cylinder itself. It is therefore possible to lay out the radiographic appliance on the internal and external faces of the cylinder welding zone and therefore control the quality of the welding itself, verifying that this fulfils the requirements of resistance to the elevated mechanical stress to which it is submitted.

Further preferable features and embodiments of the invention are indicated below with reference to examples of embodiment that are not limiting and in the dependent claims at the end of this description.

BRIEF DESCRIPTION OF THE DRAWINGS

The invention is better understood following the description and the drawing, which shows practical non limiting embodiments of the invention. More specifically in the drawing:

FIG. 13A, 13B, 13C show an enlargement of the detail indicated with XII in FIG. 11, according to three alternative embodiments.

DETAILED DESCRIPTION OF THE EMBODIMENTS OF THE INVENTION

Figure 1:
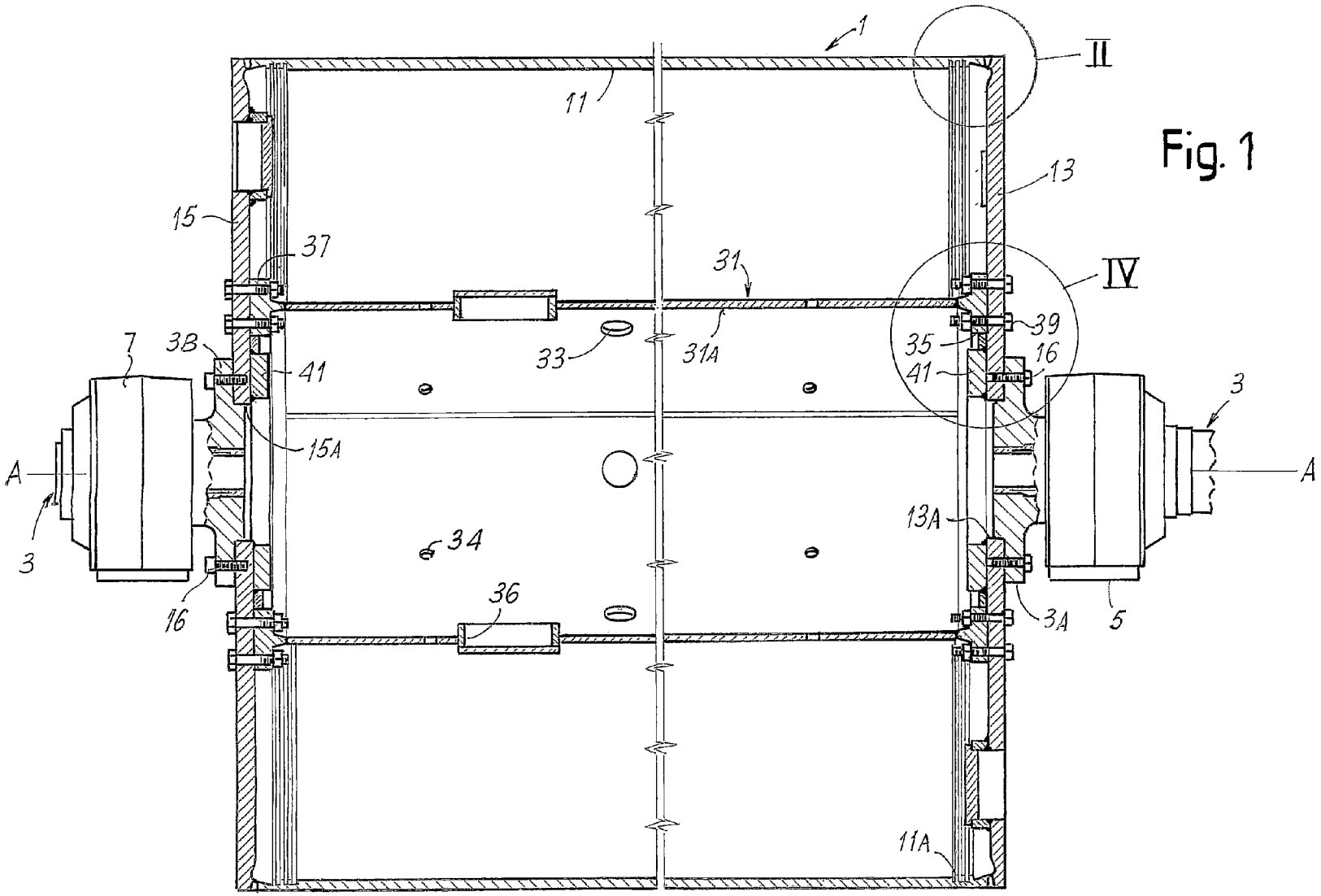
FIG. 1 shows a longitudinal section of a Yankee cylinder in a first embodiment.

With initial reference to FIGS. 1 to 5 a first configuration of the Yankee cylinder according to the invention will be described below. In FIG. 1 the composition of the Yankee cylinder is shown in a longitudinal section containing the rotation axis A-A of the cylinder itself. The cylinder includes a main body 1 and two journals 3 through which the cylinder is supported by means of roller bearings 5 and 7. Through journals 3 a thermal carrier fluid is circulated, usually steam, that fills the internal chamber of the Yankee cylinder. The chamber is constructed in body 1 of the cylinder, which is defined by a cylindrical shell 11 composed of a rolled metal sheet with abutting edges and welded along a generatrix or along a line sloped on the cylindrical surface of the cylinder itself.

The final cylindrical shell can also be manufactured through jointing of two or more cylinders obtained by rolling and welding metal sheets. In this case the jointing between two adjacent cylindrical shells can be realized through circumferential welding, if the contact occurs on a line orthogonal to the axis of the shell, or elliptical welding, if the contact occurs on a sloping plane with respect to the axis of the shell. The shell Ills joined to the ends 13 and 15 to which are in turn fixed, in a way which will be described below, the journals 3.

In a preferable embodiment, each journal 3 has a flanged portion 3A joined for example through bolts 16 to respective end sides 13. The screws 16 are arranged in a circular lay out around the holes 13A and 15A realized in the ends 13 and 15.

The internal surface of the rolled sheet metal forming the cylindrical shell 11 is provided with circular grooves 11A within which the condensate is collected that forms by the release of thermal energy from the steam fed into the internal chamber of the body 1 of the Yankee cylinder towards the circumference. In a way that is known and not shown here the condensate is extracted from the bottom of the circular grooves 11A and re-cycled.

According to a preferable embodiment the cylindrical shell 11 is joined to the ends 13 and 15 through a welding produced with circular welding beads.

Figure 2:
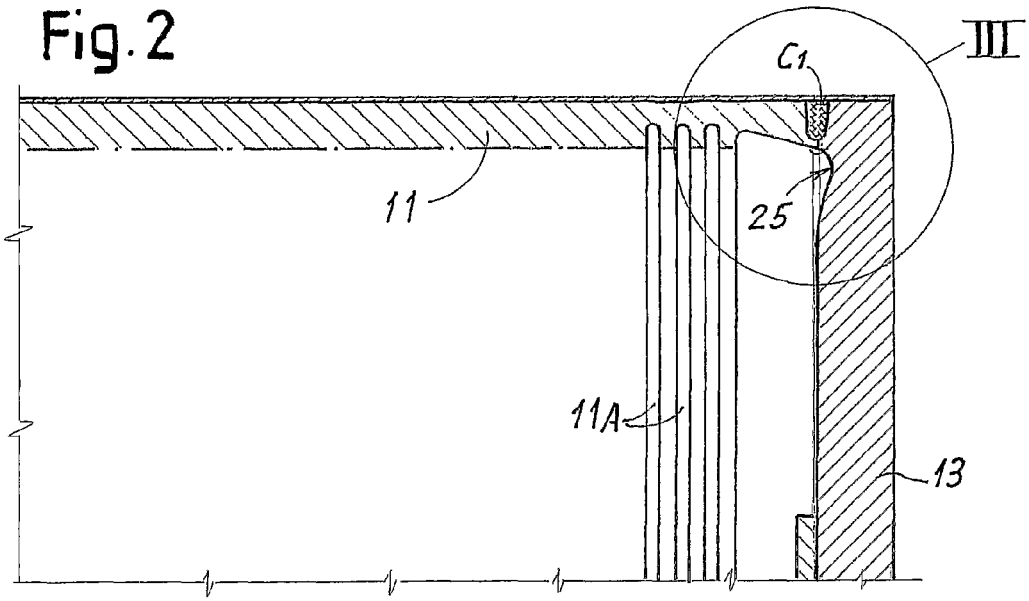
FIG. 2 shows an enlargement of a portion of the Yankee cylinder in of the welding area between one of the ends and the cylindrical shell.
Figure 3:
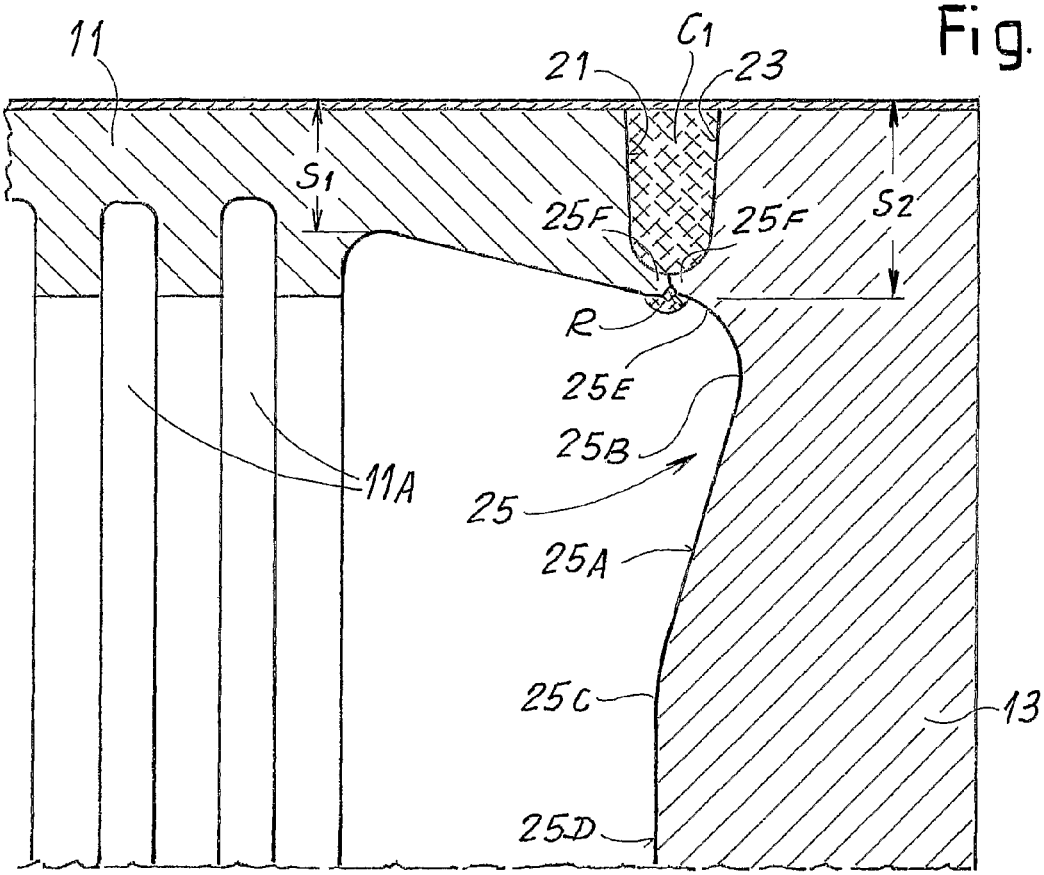
FIG. 3 shows an enlarged detail of the welding of FIG. 2.

FIGS. 2 and 3 show in detail a way of producing the joining welding between end 13 and the cylindrical shell 11. The welding of the opposing end 15 of shell 11 is produced in a substantially symmetrical manner.

With reference to FIGS. 2 and 3, a preferable embodiment foresees a welding with a U-shaped cross section, composed of a weld bead indicated with C1 in FIG. 3, formed by a bead which fills a cavity defined between a front bevel 21 on the respective end of the cylindrical shell 11 and a bevel 23 on a surface of the end 13 facing the cylindrical shell.

The weld bead is preferably of a flat type, its external surface is flush with the external surface of the cylindrical shell 11. If the latter is provided with a hard facing, for example applied with an arc, the coating forms a continuous layer on the cylindrical surface of the shell 11 and the weld bead.

To make the weld bead C1, formed by the material placed in the space defined between the bevels 21 and 23, accessible to a radiographic system, according to an advantageous embodiment the end 13 is provided with a circular depression 25 which develops around the axis A-A of the Yankee cylinder, adjacent to the position in which the weld bead C1 is formed. In an advantageous embodiment (see in particular FIG. 3) the circular depression 25 has a beveled transversal section with a profile defined by large radius curves joined to the nearby surfaces of the respective end. This annular depression or concavity 25 can have for example a bottom surface 25A which gradually rises in a radial direction towards the axis of the Yankee cylinder from a position 25B of maximum depth of the depression 25 to a position 25C to join to the essentially flat front surface 25D of the end 13.

Furthermore, according to an advantageous embodiment of the invention, the depression 25 has a circular connection 25E arranged radially to the outside with respect to the position of maximum depth 25B of the cavity or circular depression 25, which develops towards the inside of the chamber of the Yankee cylinder defining a circular edge 25F forming at least part of the wall of the bottom of the U-shaped volume in which the weld bead C1 is formed. An opposing edge 25F circular in shape is formed on the front wall of the cylindrical shell 11. The two opposing circular edges 25F are abutting to limit the volume of the bead C. According to a preferred embodiment of the invention, on the internal face of the edges 25F is a back weld is provided, indicated with R. The back weld can be in provided in correspondence of two bevels formed on the opposing circular edges 25F that guide the formation of the back weld itself.

In a modified embodiment, the weld bead C1 can be on the inside of the cylinder and the back weld R on the outside.

It is understood from FIGS. 2 and 3 that the weld bead C1 and the back weld R can be easily radiographed thanks to their position in relation to the elements 11 and 13 and in particular thanks to the circular depression 25. The latter, furthermore, causes a deviation of the lines of force within the material forming the Yankee cylinder when this is submitted to the stress generated during operation. This shape of lines of force reduces the stress on the weld bead and therefore the risk of its failing.

According to an advantageous embodiment, also the position of the cylindrical shell 11 directly adjacent to the weld bead C1 presents a structure designed specifically to improve the conditions of loading of the weld bead and to increase the thickness of the bead C1 in a radial direction. According to an advantageous embodiment, shown in particular in FIG. 3 the cylindrical shell 11 presents, close to each of the end edges, a cylindrical wall portion of a gradually growing thickness from a zone of minimum thickness S1 to a zone of maximum thickness S2 behind the weld bead C1.

Figure 6:
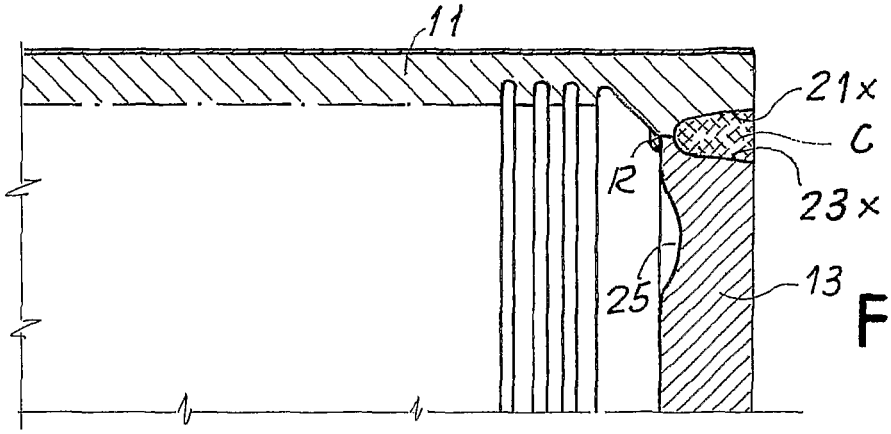
FIG. 6 shows a similar enlargement to that of FIG. 3 of an alternative embodiment of the welding between the end and the shell.

In this embodiment, therefore, the ends 13 and 15 are butt joined to the front edges of the cylindrical shell 11 with a U shaped bead with internal back weld. According to a different embodiment, the possibility of realizing the junction by welding ends 13, 15 to the cylindrical shell 11 by inserting the ends into the inside of the cylindrical shell is not excluded. FIG. 6 shows, a configuration of this kind, in an enlarged section similar to the section of FIG. 3. In this case the weld bead, still indicated as C1 and U-shape, is in a position defined between two opposing bevels, the first on a circumferential edge of the end 13, and indicated with 23X and the other on an internal portion of the cylinder shell 11, indicated with 21X. In an advantageous embodiment, the welding is formed with an internal back weld R Preferably, also in this case within the end 13 is a depression, indicated with 25, having a circular shape and arranged adjacent to the weld bead C1 and its back weld R made on the internal surface of the unit 11, 13. In this case the depression 25, again characterized by a particularly gentle profile of its cross section and with large curvature radii, optimizes the shape of the lines of force in the area of the weld itself, reducing the stress to which this is subjected by effect of the internal pressure of the Yankee cylinder.

In a modified embodiment, the weld bead C1 can be on the inside of the cylinder and the back weld R on the outside.

In a modified embodiment, the joining weld of each end to the cylindrical shell can have a V shape, a ½V shape, preferably with a back weld, or a K or X shape, with an internal and external bead. It is not excluded that the weld is a double U, rather than U with opposing back weld. The illustrated weld, nonetheless, presents greater resistance for the kind of stresses to which it is subjected.

The two ends 13 and 15 of the Yankee cylinder are joined not only by the cylindrical shell 11, but also by an internal tie indicated as 31. In an advantageous embodiment, the internal tie 31 is coaxial to the cylinder and is in the form of a tubular structure. In an advantageous embodiment the internal tie 31 can be pre-taut, to compensate for the thermal stress due to the differential expansions between the various parts of the Yankee cylinder.

In an advantageous embodiment the tubular structure of the tie 31, indicated by 31A, is provided with suitable holes 33 for the passage of the ducts of the condensate extraction system (not shown in the drawing), as well as holes 34 of a smaller diameter for the circulation and distribution of the steam. The tie 31 are furthermore provided with suitable human passages 36 for access and maintenance within the circular crown-shaped volume. The tubular structure of the tie 31 is butt joined to two respective annular bodies 35 and 37, one of which is shown in particular in FIG. 4. The annular bodies 35 and 37 are bound to the respective ends 13 and 15. For this purpose each of the two annular bodies 35 is provided with a series of through holes arranged externally and a series of through holes arranged internally with respect to the circumference along which the tubular structure 31A is but welded to the annular body 35. The junction between the annular body 35, 37 and the end 13, 15 is obtained through two series of screws 39 arranged respectively externally and internally of an ideal cylindrical surface forming an ideal extension of the tubular structure 31A.

Through suitable elements it is possible, during assembly, to submit the structure 31A and the annular bodies 35, 37 to traction stress.

Within each annular body 35, 37 is provided a reinforcement ring 41 welded in 43 and 45 with a double weld bead around the opening 13A, 15A, of the end 13 or 15 respectively.

In an advantageous embodiment (see in particular enlargement of FIG. 5), the junction between the tubular structure 31A of the tie 31 and the annular bodies 35, 37 is obtained through a K or X shaped weld, made with a double weld bead C2 formed in the space formed by two V shaped bevels of the surface of the front end of the tubular structure 31A and a circular edge 45 (or a V shaped edge) of the respective annular body 35, 37.

Figure 4:
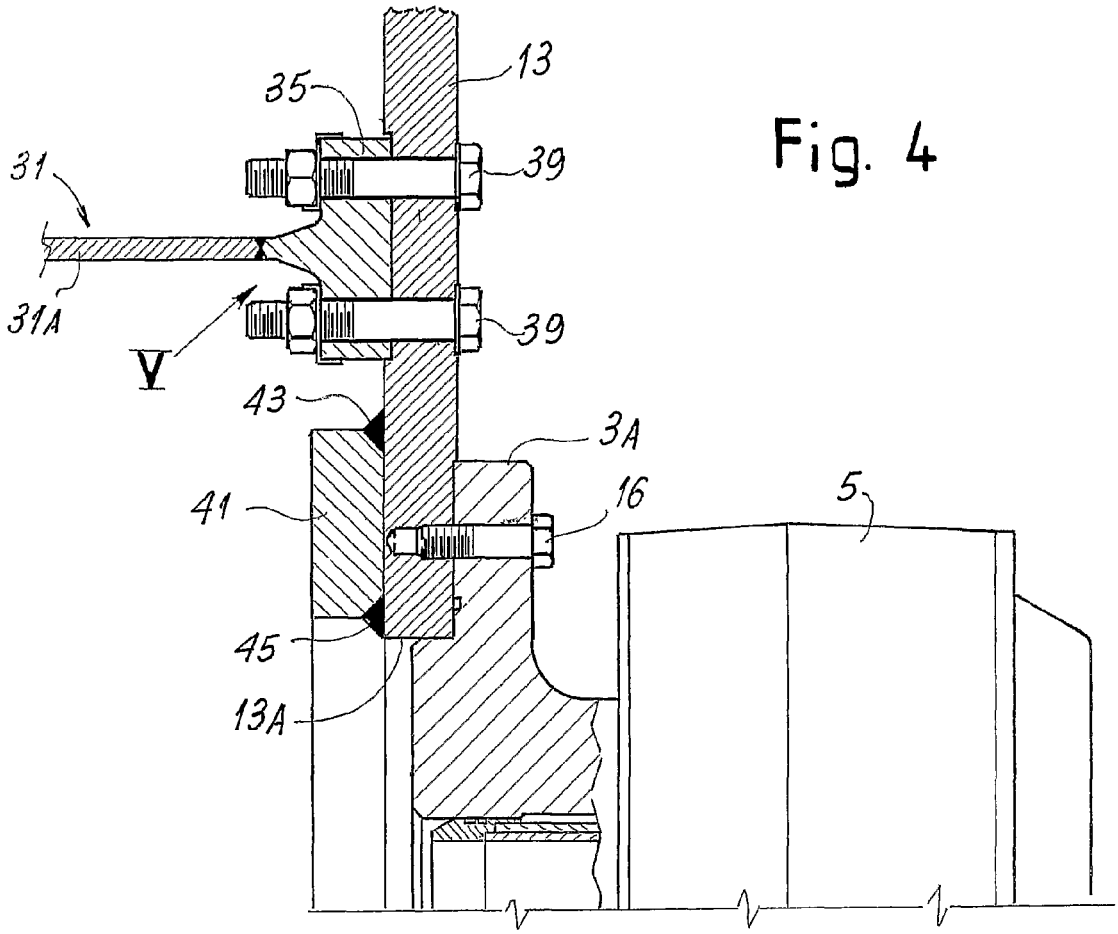
FIG. 4 shows an enlargement of the portion of anchorage of a tie inside the cylinder and coaxial to it.
Figure 5:
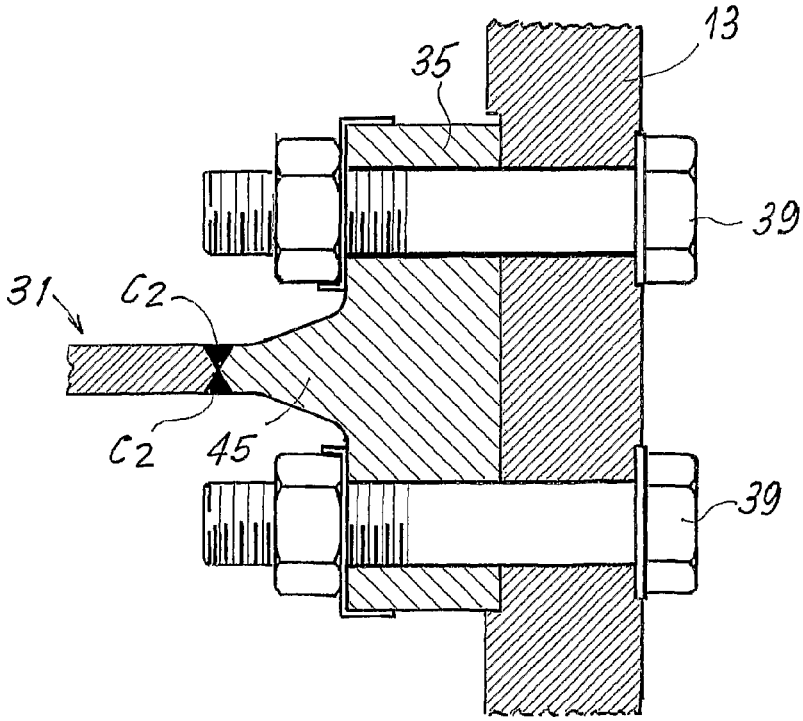
FIG. 5 shows an enlargement of the welding area and anchorage of the tie at the respective end.
Figure 8:
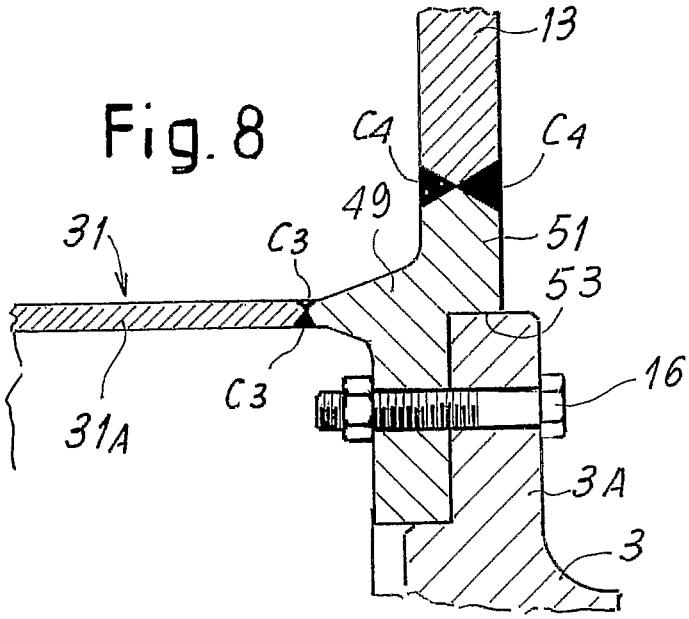
FIGS. 8 and 9 show an alternative embodiment of the anchorage of the inside tie at the respective end of the Yankee cylinder.

The structure of the central tie 31 and its junction to the ends 13, 15 can also be made according to different configurations with respect to that illustrated in FIGS. 4 and 5. An alternative embodiment is shown in FIG. 8. In this case the tie 31 has a tubular structure 31A butt welded, with, K-shaped or X-shaped double bead C3, to an annular projection 49 formed on an annular body 51 welded by means of a double weld bead C4 within a hole located in the respective end 13 or 15. The annular body 51 has a housing 53, within which is inserted the flanged portion 3A of the respective journal 3, which is then fixed to the complex formed by end 13 with the circular body 51 rigidly welded to it through a screw coupling as shown in FIG. 8.

Figure 9:
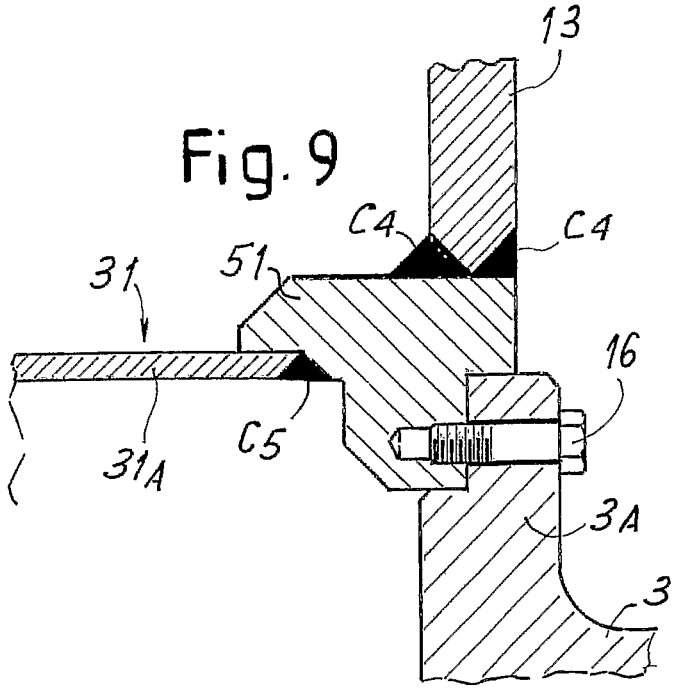

FIG. 9 shows another embodiment of the junction between the tie 31 and the ends 13, 15 of the Yankee cylinder. In this configuration the weld between the tubular structure 31A and the circular body 51 is not a but weld with double bead C3, C3 as shown in FIG. 8, but rather formed with a single weld bead C5. The annular body 51 is still joined by a weld bead C4, C4 to the main part of the end 13 and the complex 13, 51 is connected with a screw coupling to the flanged part 3A of the respective journal 3. The screw connection can be realized by screwing the screw into a blind hole (as shown in FIG. 9) or screwing it through a passing hole to a nut placed inside the cylinder.

In the embodiments described to now the coupling between the cylindrical shell 11 and the ends 13, 15 is obtained exclusively by welding eliminating the use of screws or bolts which, usually used in the configurations known, have multiple drawbacks including the risk of being subjected to high flexural stress to which these mechanical components are unable to resist with adequate safety, and also imply risk of failing to guarantee an adequate seal between the inside and outside of the cylinder due to the flexural deformations, due to the effect of the internal pressure during operation. A flexural deformation of this kind weakens the seal between the surfaces joined by bolts of the cylindrical shell and the ends with consequent leakage of overheated steam from the inside of the cylinder. A second potential problem is the fact that a bolted connection does not protect from the infiltration of oxidizing agents between the connection surfaces. If, for example, following the stress of operation, even a partial separation of the connection surfaces were to occur, humidity possibly mixed with chemical agents present in the process could penetrate between the surfaces. In this condition a layer of oxide could form preventing closure of the connection. This layer of oxide can over time increase in thickness until it compromises the safety of the connection.

Figure 7:
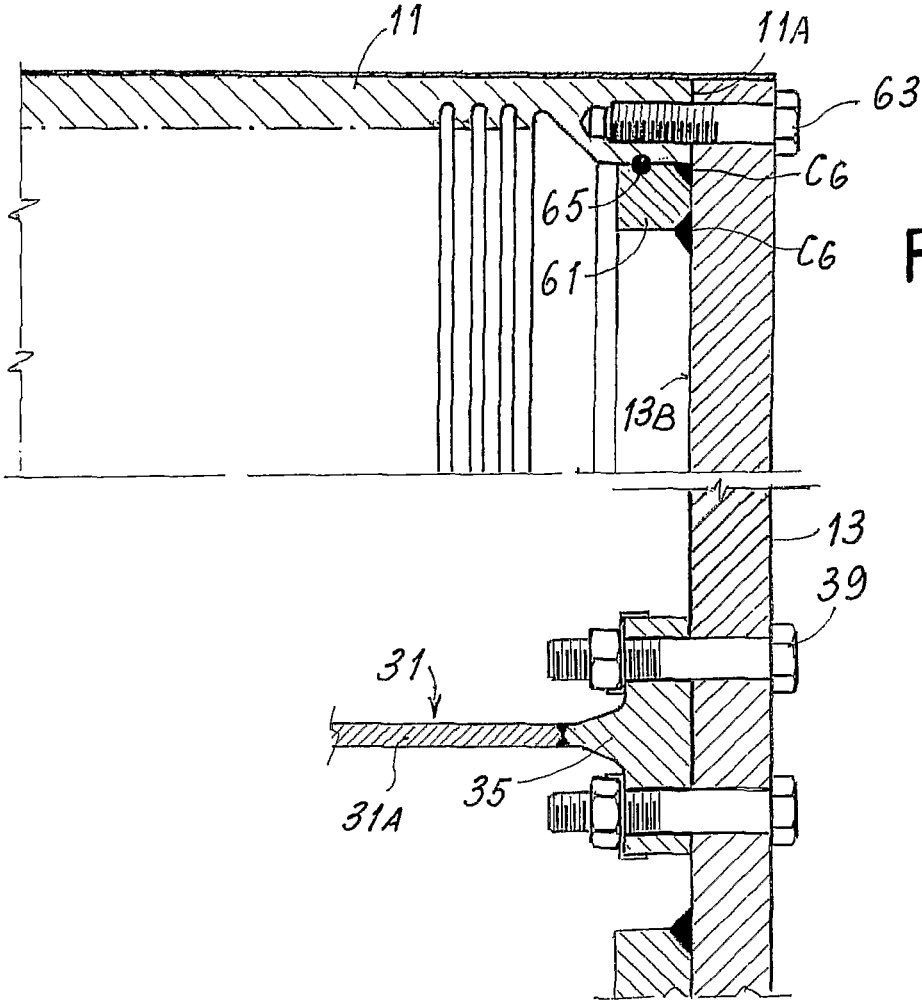
FIG. 7 shows a similar enlargement to that of FIG. 6 of a modified embodiment of the invention.

FIG. 7 shows a modified embodiment of the invention, in which the junction between the cylindrical shell 11 and the ends 13, 15 occurs through the use of a crown of screws or bolts, but avoiding the aforementioned drawbacks deriving from an elevated flexural stress of the screws. Equal numbers indicate equal or equivalent parts to those of the previous embodiment.

In this embodiment, on the internal surface 13B of the end 13 (a similar configuration is provided on the end 15 not shown) a ring 61 is welded for example through a V-shaped weld bead C6 (without with this wanting to exclude other and different forms of weld bead). Ring 61 has an externally cylindrical surface of a diameter substantially equal to the internal diameter of the end portion of the cylindrical shell 11, which is placed around ring 61 and brought to abut with its front surface 11A against the internal front surface 13B of the end 13. A series of screws 63 mechanically connect the end 13 and the cylindrical shell 11. A similar junction is required between end 15 and the other end of the cylindrical shell 11.

With this conformation the flexural stress induced by the internal pressure of the Yankee cylinder on the junction between the components 13,15 and the component 11 is released onto ring 61 and therefore onto the end 13 as well as onto the end 15, while screws 63 are subjected essentially only to tensile stress and only marginally to flexural stresses, or in any case to flexural stresses of no relevance.

This conformation also presents the further advantage of allowing the application of a seal gasket 65 for example a gasket in rubber or copper. This can be lodged in a circular housing in the externally radial surface of the ring 61, i.e. the surface on contact with the cylindrical shell 11. This gasket further guarantees against the leakage of steam under pressure from the Yankee cylinder.

FIG. 7 shows a structure of tie 31 essentially equivalent to those of FIG. 1 to 5 but it must be understood that in this case the tie 31 can be anchored for example as shown in FIGS. 8 and 9.

Figure 10A:
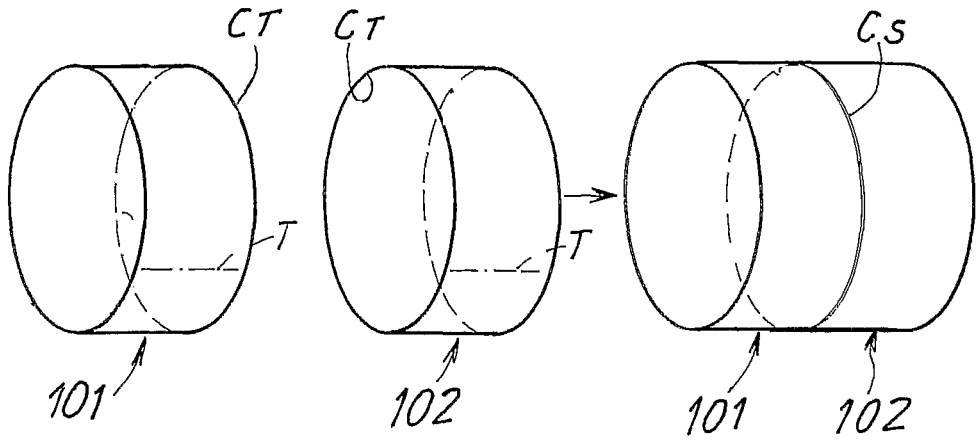
FIG. 10A, 10B schematically show two methods for the construction of the cylindrical shell of the Yankee in multiple sections welded together.
Figure 10B:
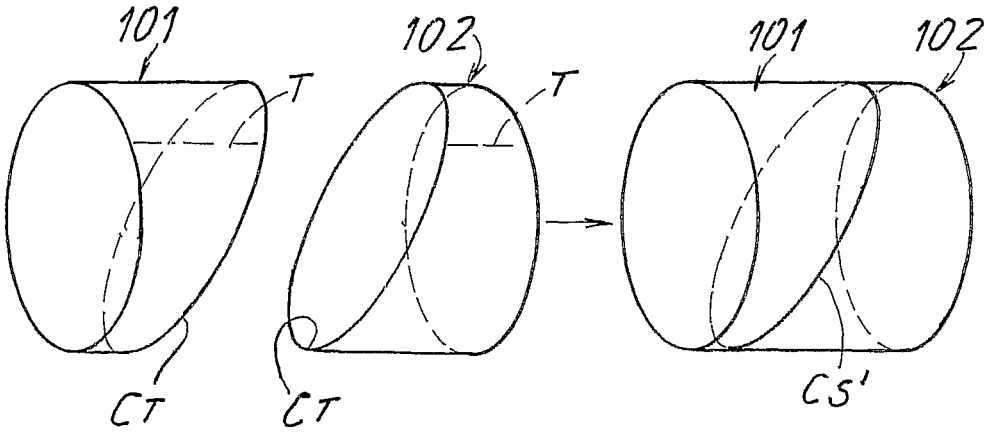

Body 1 of the Yankee cylinder can be manufactured with a single metal sheet of a width equal to the length of the cylinder, shaped and with butt welded opposing edges. Nevertheless, above all in the case of Yankee cylinders of elevated axial length, the cylindrical shell of body 1 can be produced in multiple sections, for example by two sheet metals each shaped to form a cylindrical wall and then welding the two cylinder portions to one another along a circular line. This way of forming body 1 of the Yankee cylinder is shown in FIG. 10A. 101 and 102 indicate the two shaped sheet metals butt welded at T. CT indicates two circumferential butt edges welded to each other to form a single circumferential welding line CS, which is located on a plane orthogonal to the axis of the cylinder. FIG. 10B shows a method of manufacturing the cylindrical shell 1 of the Yankee cylinder with two portions of sheet steel 101, 102 which have opposing inclined edges, so that welding of the two portions of the cylindrical shell 1 of the Yankee cylinder occurs along a line CS' lying n a plane which is non orthogonal to the axis of the cylinder. If necessary, the cylindrical shell can be obtained by welding together more than two portions according to what is illustrated in FIGS. 10A and 10B.

In an advantageous embodiment, the Yankee cylinder can be provided with ends 13,15 having a curved or partially curved cross section, with a concavity turned to the outside and a convexity turned towards the inside of the cylinder. In a possible embodiment the curved portion of the ends is formed by means of a circular wall with a curved cross section (that is a section according to a radial plane). In one embodiment the wall is welded along an external circumference of the shell or to a flat circular portion of the end. In one embodiment this circular wall is welded along an internal circumference to a circular plate, preferably flat, defining the central part of the end, to which the relevant journal is fixed. The curved shape allows greater resistance to the high pressure inside the cylinder, with thinner wall thicknesses than that of a flat wall.

Figure 11:
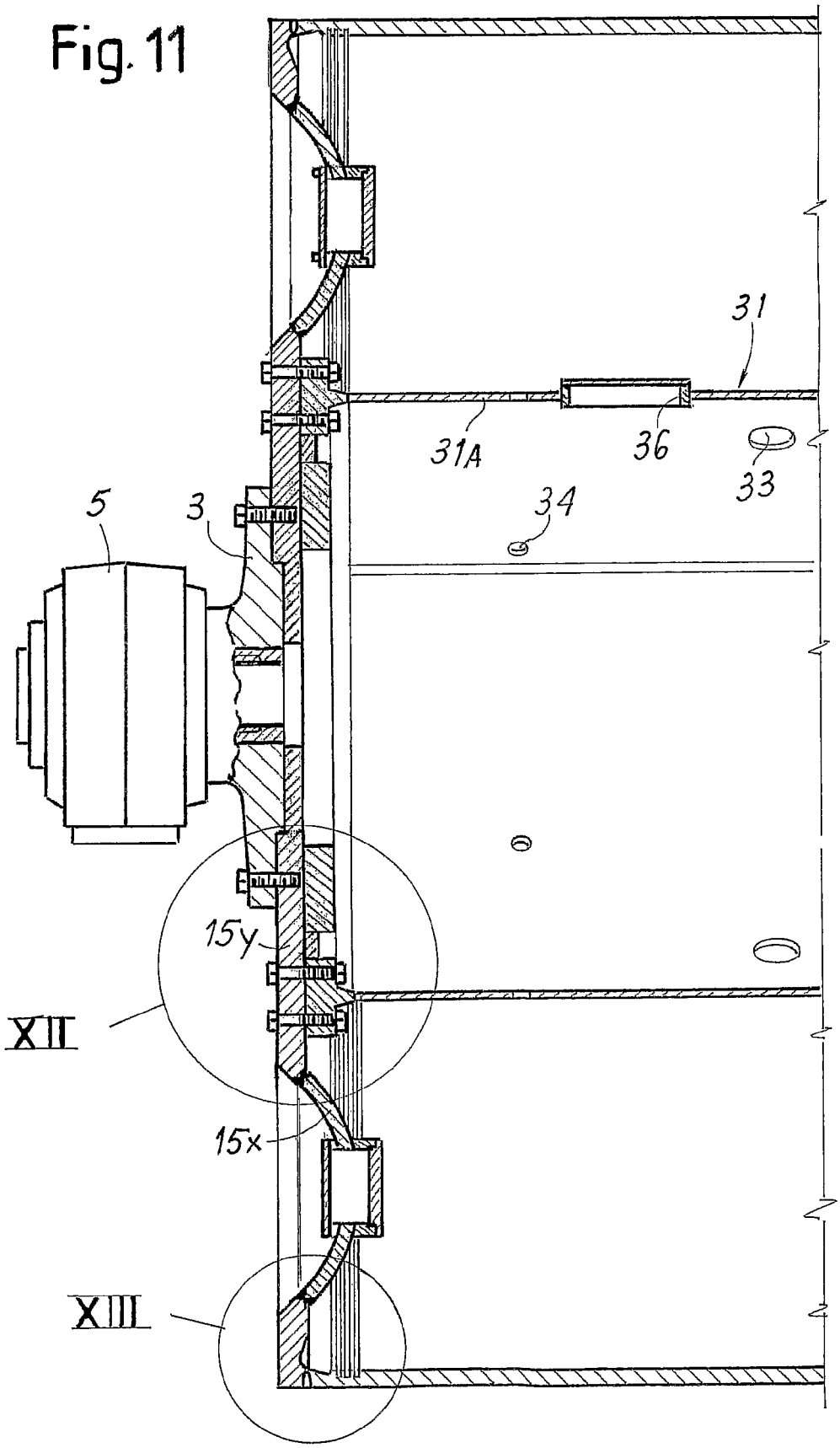
FIG. 11 shows a partial longitudinal section of a Yankee cylinder in a modified embodiment, with curved end.
Figure 12A:
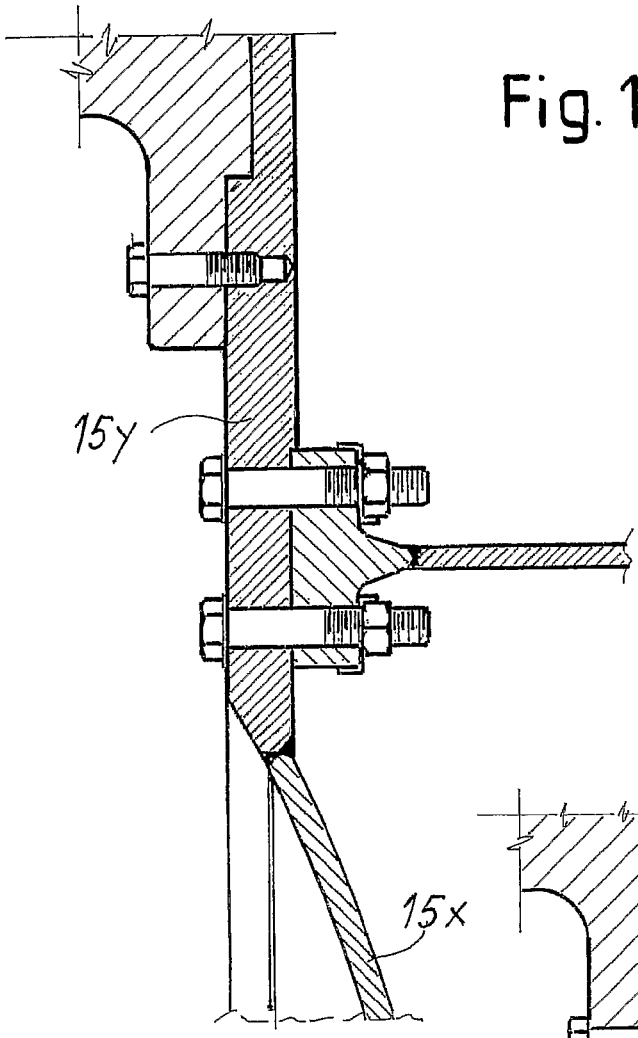
FIGS. 12A and 12B show an enlargement of the detail indicated with XII in FIG. 11, according to two alternative embodiments.

FIG. 11 shows a longitudinal section of one of the two ends, in the example of end 15, of the Yankee cylinder with curved end. 15X indicates a curved wall having an annular development, with the concavity facing outwards. It is welded along a circumferential edge internally to a circular flat plate 15Y forming the central portion of the end 15, to which the journal 3 is fixed. Along an external circumferential edge the portion of curved wall 15X is welded to an external ring 15Z. In an embodiment (FIG. 11, 12A) the diameter of the annular plate 15Y is such that the internal tubular tie 31 is anchored to annular plate 15Y itself. The diameter of the weld between walls 15X and 15Y is therefore greater than the diameter of the internal tie 31. In a possible embodiment, the weld between walls 15X and 15Y is a double U or double V shaped weld, as shown in FIG. 12A. In a modified embodiment, the weld can be a ½ V weld. In general, the weld will present a double weld bead, internally and externally, or a weld bead on a face and a back weld on the other.

In a modified embodiment (FIG. 12B) the diameter of the plate 15Y is less than the diameter of the internal tubular tie 31, so that the latter is anchored, with one of the systems already described in precedence, to the portion of curved wall 15X. To this end, the wall 15X can present for example flattened angular portions 18A, 18B along which rest the heads of the fixing screws or bolts. In one embodiment on the internal surface of the annular curved portion 15X, between the latter and the tie 31, is inserted a compensator ring 18C.

Along the external circumferential border the portion of curved wall 15X is welded with a double U, double V, ½ V weld, with a weld bead on one face and a back weld on the other, or with any other suitable shape of the weld, to the external ring 15Z (FIG. 13A), which in turn is welded to the cylindrical shell 11. In this embodiment the cross section of the ring 15Z is shaped like the diametrically more external portion of the ends 13, 15 described with reference to FIGS. 1 to 9. The weld on the terminal edge of the cylindrical shell 11 is made in a similar way.

In a modified embodiment (FIG. 13B), the portion of curved wall 15X is welded with a U shaped weld and an internal back weld, or with a double U, double V, ½ V shaped weld or with other suitably shaped welds, directly to a circumferential edge of the end of the cylindrical shell 11. For example, the cylindrical shell 11 can have a circular edge turned inwards, as shown in FIG. 13B along which is the weld with the external circumferential edge of the curved circular part 15X is formed. Preferably, the weld is realized with an external weld bead and an internal back weld, with a similar solution to that of the weld of FIG. 6.

In a further embodiment (FIG. 13C) the curved annular portion 15X has an external diameter equal to the external diameter of the cylindrical shell 11 and the latter is butt welded to the internal surface of the wall 15X. In a possible embodiment the weld is realized with an external circular bead and an internal back weld (FIG. 13C) though not excluding other constructive solutions.

Figure 12B:
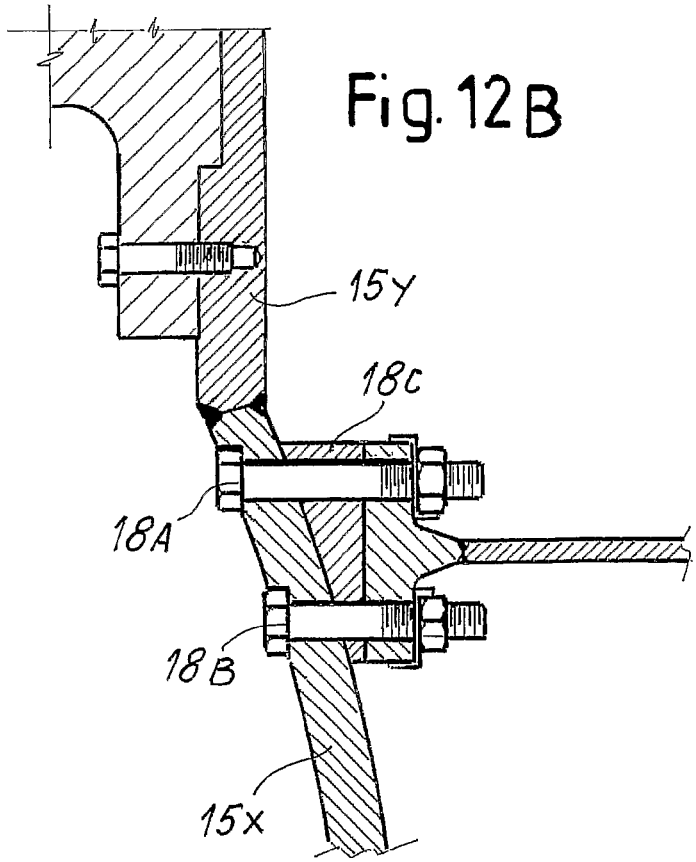

Each of the embodiments of the most external radial welds (FIG. 13A, 13B,13C) can be combined to an embodiment of the most internal radial welds (FIG. 12A, 12B).

Curved ends as in FIG. 11,12A,12B,12C,13A,13B can also be used in a Yankee cylinder of the kind shown in FIG. 7.

It is understood that the drawing is an example given only as a practical demonstration of the invention, as this can vary in the shape and layout without getting away from the concept underlying the invention itself. Any reference number in the claims attached has the aim of facilitating reading of the claims with reference to the description and the drawing, and does not limit the scope of the protection represented by the claims.

The invention claimed is:

1. A steel-made Yankee cylinder comprising:

a cylindrical shell joined at two ends, to which are fixed respective support journals, wherein the cylindrical shell is joined to each of said ends through a respective circumferential weld bead on the outside of the Yankee cylinder made between opposing surfaces of each end and the cylindrical shell respectively, and a corresponding back weld bead on the inside of the Yankee cylinder; and wherein said cylindrical shell has, close to each of its end edges, a portion of cylindrical wall of a thickness gradually increasing from a zone of minimum thickness to a zone of maximum thickness in correspondence of which said weld bead is formed.

2. A Yankee cylinder according to claim 1, wherein the zone of minimum thickness of said portion of cylindrical wall is adjacent to a circular groove for collecting the condensate generated by transfer of heat from said steam circulating in said cylinder, said minimum thickness being larger than the thickness of the cylindrical wall in correspondence of said circular groove.

3. A Yankee cylinder according to claim 1, wherein said weld bead and said back weld bead have a cross section with a shape selected from the group including: a U shaped cross section with a backing, an X cross section, a K cross section.

4. A Yankee cylinder according to claim 1, wherein each weld bead develops on the respective front surface of the Yankee cylinder.

5. A Yankee cylinder according to claim 1, wherein said weld bead develops on the cylindrical surface of the Yankee cylinder.

6. A Yankee cylinder according to claim 5, wherein each weld bead is formed in a space defined between a front bevel on the respective edge of the cylindrical shell and a bevel on a surface of the end turned towards the shell.

7. A Yankee cylinder according to claim 1, wherein each of said ends include, close to the weld bead, a circular depression.

8. A Yankee cylinder according to claim 7, wherein said circular depression is formed on the internal surface of the respective end.

9. A Yankee cylinder according to claim 7, wherein said circular depression has a beveled cross section, with a profile defined by large diameter radii connecting to the surrounding surfaces of the respective end.

10. A Yankee cylinder according to claim 1, wherein each of said ends has, on the surface towards the inside of the cylinder, an annular concavity with a bottom which is gradually rising from an area of maximum depth of said annular concavity radially towards the inside of the cylinder to an internal essentially flat front surface of the respective end, and an annular connection from said zone of maximum depth towards an annular projection defining partially the bottom of a cavity in which the weld bead is formed, the back weld of the welding bead being formed on said annular projection.

11. A Yankee cylinder according to claim 1, wherein said ends are butt welded to the front edges of the cylindrical shell.

12. A Yankee cylinder according to claim 1, wherein said ends are inserted inside the cylindrical shell and each of them is surrounded by an end zone of the cylindrical shell.

13. A Yankee cylinder according to claim 12, wherein the opposing surfaces of each of said ends and the cylindrical shell are beveled to define a space in which the weld bead is formed, which is arranged inside the respective end of the cylindrical shell.

14. A Yankee cylinder according to claim 1, wherein said ends each have at least one curved portion.

15. A Yankee cylinder according to claim 14, wherein the ends have a curved annular portion, with a convexity turned towards the inside of the cylinder and a concavity towards the outside of the cylinder.

16. A Yankee cylinder according to claim 14, wherein each of said ends has an annular curved wall with a concavity towards the outside of the cylinder and a convexity towards the inside of the cylinder, sealed along a circumferential edge inside a central plate, to which the respective journal of the cylinder is connected.

17. A Yankee cylinder according to claim 16, wherein said curved annular wall has an outside circumferential edge, welded to a respective end edge of the cylindrical shell.

18. A Yankee cylinder according to claim 17, wherein said curved annular wall has an outside circumferential edge, welded to a lateral ring, in turn welded to a corresponding end edge of the cylindrical shell.

19. A Yankee cylinder according to claim 14, further comprising an internal tie anchored to the curved portion of each end.

20. A Yankee cylinder according to claim 16, further comprising an internal tie, anchored to said central plate.

21. A Yankee cylinder according to claim 1, wherein the internal surface of the cylindrical shell is provided with a number of circular grooves for collection of the condensate formed by the steam fed into said cylinder.

22. A Yankee cylinder according to claim 1, further comprising at least one internal tie coaxial to the cylinder.

23. A Yankee cylinder according to claim 22, wherein said internal tie is pre-taut.

24. A Yankee cylinder according to claim 22, wherein said internal tie includes a tubular structure, bound to its ends through circular welding to annular anchorage bodies anchored to the ends of the Yankee cylinder.

25. A Yankee cylinder according to claim 24, wherein said annular bodies are welded to said ends.

26. A Yankee cylinder according to claim 24, wherein said annular bodies are anchored to the ends by bolts.

27. A Yankee cylinder according to claim 24, wherein said tubular structure is butt welded to said annular bodies.

28. A Yankee cylinder according to claim 27, wherein each annular body is welded to the tubular structure through a double weld bead, internally and externally to the tubular structure with an X or K shaped weld.

29. A Yankee cylinder according to claim 1, wherein a metal superficial hardening edge is provided on the external surface of the cylindrical shell.

30. A Yankee cylinder according to claim 1, wherein the cylindrical shell is formed by a single metal sheet with front edges welded along a straight line, essentially parallel to the axis of the cylinder, or according to an helicoidal line.

31. A Yankee cylinder according to claim 1, wherein the cylindrical shell is formed by at least two cylindrical portions, each formed by a metal sheet butt welded along a line substantially parallel to the axis of the cylinder or helicoidal, and welded to one another along a substantially circular or elliptical weld line.

32. A Yankee cylinder according to claim 2, wherein said weld bead and said back weld bead have a cross section with a shape selected from the group including: a U shaped cross section with a backing, an X cross section, a K cross section.

33. A Yankee cylinder according to claim 2, wherein each weld bead develops on the respective front surface of the Yankee cylinder.

34. A Yankee cylinder according to claim 3, wherein each weld bead develops on the respective front surface of the Yankee cylinder.

35. A Yankee cylinder according to claim 2, wherein said weld bead develops on the cylindrical surface of the Yankee cylinder.

36. A Yankee cylinder according to claim 35, wherein each weld bead is formed in a space defined between a front bevel on the respective edge of the cylindrical shell and a bevel on a surface of the end turned towards the shell.

37. A Yankee cylinder according to claim 2, wherein each of said ends include, close to the weld bead, a circular depression.

38. A Yankee cylinder according to claim 37, wherein said circular depression is formed on the internal surface of the respective end.

39. A Yankee cylinder according to claim 18, wherein between said ring and the internal surface of the shell an annular gasket is arranged.

* * * * *